US011606984B1

(12) United States Patent
Emery et al.

(10) Patent No.: US 11,606,984 B1
(45) Date of Patent: Mar. 21, 2023

(54) THERMAL CAMOUFLAGE FABRIC WITH ZONES

(71) Applicant: Milliken & Company, Spartanburg, SC (US)

(72) Inventors: Nathan B. Emery, Spartanburg, SC (US); Michael C. Gillespie, Easley, SC (US)

(73) Assignee: Milliken & Company, Spartanburg, SC (US)

( * ) Notice: Subject to any disclaimer, the term of this patent is extended or adjusted under 35 U.S.C. 154(b) by 281 days.

(21) Appl. No.: 17/125,835

(22) Filed: Dec. 17, 2020

(51) Int. Cl.

| | |
|---|---|
| ***D06P 1/00*** | (2006.01) |
| ***D06M 11/83*** | (2006.01) |
| ***A41D 13/00*** | (2006.01) |
| ***A41D 3/00*** | (2006.01) |
| ***A41D 1/06*** | (2006.01) |
| ***D06P 1/673*** | (2006.01) |

(52) U.S. Cl.
CPC ..... *A41D 13/00* (2013.01); *A41D 1/06* (2013.01); *A41D 3/00* (2013.01); *D06M 11/83* (2013.01); *D06P 1/004* (2013.01); *D06P 1/673* (2013.01); *A41D 2600/20* (2013.01)

(58) Field of Classification Search
CPC ..... F41H 3/00; F41H 3/02; D06P 1/004
See application file for complete search history.

(56) References Cited

U.S. PATENT DOCUMENTS 4,095,940 A 6/1978 Weingarten
4,495,239 A * 1/1985 Pusch ..... F41H 3/02 442/232
5,798,304 A 8/1998 Clarkson
5,955,175 A * 9/1999 Culler ..... F41H 3/00 428/209
6,127,007 A 10/2000 Cox
(Continued)

FOREIGN PATENT DOCUMENTS

CN 101628644 B 3/2011
CN 109233410 A 1/2019
(Continued)

OTHER PUBLICATIONS

"AMS STD. 595A U.S. Army # 559 / Dark Cream LRV Value." HEX to RAL, https://hextoral.com/color-properties/u-s-army-559-dark-cream-37490-lrv/.*
(Continued)

*Primary Examiner* — Larissa Rowe Emrich
(74) *Attorney, Agent, or Firm* — Cheryl J. Brickey

(57) ABSTRACT

A thermal camouflage garment containing at least two zones, each zone containing a thermal camouflage fabric. The camouflage fabrics each contain a printed layer. In at least 90% of the wavelengths between 400-700 nm at least one of the first, second, and third color deltas are less than about 10 percentage points, and wherein at 1 μm and 2 μm and the average over 3-5 μm, average over 8-12 μm the first, at least one of the first, second, and third color deltas are greater than about 15 percentage points. The first zone makes up at least about 10% of the outer surface area of the thermal camouflage garment and the second zone makes up at least about 10% of the outer surface area of the thermal camouflage garment.

20 Claims, 3 Drawing Sheets

(56) References Cited

U.S. PATENT DOCUMENTS

| | | | | |
|---|---|---|---|---|
| 7,008,694 | B1 * | 3/2006 | Frankel | F41H 3/00 428/364 |
| 7,102,814 | B1 | 9/2006 | Hughes | |
| 7,135,424 | B2 | 11/2006 | Worley | |
| 7,163,580 | B2 | 1/2007 | Minami | |
| 7,244,684 | B2 | 7/2007 | Hexels | |
| 7,455,904 | B2 | 11/2008 | O'Keefe | |
| 7,832,018 | B2 | 11/2010 | Schwarz | |
| 7,846,510 | B2 | 12/2010 | Afshar | |
| 7,901,756 | B2 | 3/2011 | Burr | |
| 8,333,863 | B2 | 12/2012 | Kelsey | |
| 8,404,330 | B2 | 3/2013 | Bletsos | |
| 8,779,964 | B2 | 7/2014 | Kelsey | |
| 8,883,905 | B2 | 11/2014 | Takano | |
| 8,916,265 | B1 | 12/2014 | Kelsey | |
| 8,918,919 | B2 | 12/2014 | Scholz | |
| 8,932,965 | B1 | 1/2015 | Wendel | |
| 9,005,741 | B1 * | 4/2015 | Hoffer | G02B 5/223 428/209 |
| 9,062,938 | B1 * | 6/2015 | McIntosh | F41H 3/02 |
| 2004/0068036 | A1 | 4/2004 | Halladay | |
| 2004/0116025 | A1 | 6/2004 | Gogins | |
| 2006/0128243 | A1 | 6/2006 | Kong | |
| 2009/0214852 | A1 * | 8/2009 | Kelsey | H01Q 17/00 156/278 |
| 2009/0263644 | A1 | 10/2009 | Kelsey | |
| 2010/0224402 | A1 | 9/2010 | Lim | |
| 2010/0263109 | A1 | 10/2010 | Noerenberg | |
| 2011/0065347 | A1 | 3/2011 | Havird | |
| 2012/0288662 | A1 | 11/2012 | Conolly | |
| 2013/0212789 | A1 | 8/2013 | Conolly | |
| 2014/0154482 | A1 | 6/2014 | Jang | |
| 2014/0205798 | A1 | 7/2014 | Williams | |
| 2014/0227552 | A1 | 8/2014 | Lau | |
| 2014/0242355 | A1 | 8/2014 | Castille | |
| 2014/0304883 | A1 | 10/2014 | Morag | |
| 2014/0356574 | A1 | 12/2014 | Conolly | |
| 2015/0192392 | A1 * | 7/2015 | Wendel | C09B 21/00 428/196 |

FOREIGN PATENT DOCUMENTS

| | | | |
|---|---|---|---|
| JP | H01297462 | A | 11/1989 |
| JP | H03205463 | A | 9/1991 |
| JP | 200453039 | | 2/2004 |
| JP | 2004053039 | A | 2/2004 |
| JP | 3572173 | B2 | 9/2004 |

OTHER PUBLICATIONS

"AMS STD. 595A U.S. Army # 525 / Tan LRV Value." HEX to RAL, https://hextoral.com/color-properties/u-s-army-525-tan-30373-lrv/.*

"AMS STD. 595A U.S. Army # 560 / Light Sage LRV Value." HEX to RAL, https://hextoral.com/color-properties/u-s-army-560-light-sage-34203-lrv/.*

"AMS STD. 595A U.S. Army # 527 / Olive LRV Value." HEX to RAL, https://hextoral.com/color-properties/u-s-army-527-olive-34256-lrv/.*

"AMS STD. 595A U.S. Army# 528 / Dark Green LRV Value." HEX to RAL, https://hextoral.com/color-properties/u-s-army-528-dark-green-34101-lrv/.*

"AMS STD. 595A U.S. Army # 529—Brown LRV Value." HEX to RAL, https://hextoral.com/color-properties/u-s-army-529-brown-30098-lrv/.*

"AMS STD. 595A U.S. Army # 561 / Bark Brown LRV Value." HEX to RAL, https://hextoral.com/color-properties/u-s-army-561-bark-brown-30037-lrv/.*

CN109233410A Machine Translation via EPO.

History and Features of Military Textiles via Textile Learner; Jul. 22, 2014; 18 pages; https://textilelearner.net/ military-textiles-features-characteristics-and-materials/ (Year:2014).

JP H03-205463A Machine Translation via EPO.

Complete Textile Glossary, Woven Fabric, Celanese Acetate LLC. (Year: 2001) 212 pages.

Eckart, "IReflex" Product Information, Sep. 22, 2015 <https://web.archive.org/web/20150922064827/http://www.eckart.net.coatings/industrial-coatings/wood-coatings/aqueous-systems/functiona;/ireflex.html> 2 pages.

Mehrizi, M. Khajeh, et al. "Effect of Carbon Black Nanoparticles on Reflective Behavior of Printed Cotton/Nylon Fabrics in Visible/near Infrared Regions." Fibers and Polymers, vol. 13, No. 4, May 3, 2012, pp. 501-506., doi: 10.1007/s12221-012-0501-5. (Year: 2012).

Rouette, Hans-Karl. "Dyeing of Cotton." Encyclopedia of Textile Finishing. Woodhead Publishing, 2001. 132. Retrieved from https://app.knovel.eom/hotlink/toc/id:kpETF00001/encyclopedia-textile/encyclopedia-textile (Year: 2001) 2 pages.

* cited by examiner

THERMAL CAMOUFLAGE FABRIC WITH ZONES

BACKGROUND

Camouflage textiles are typically used to reduce the discoverability of a soldier in the visible and near infrared of the electromagnetic spectrum. However, as technology advances and thermal imaging devices become more advanced and readily available, there is a need to protect the soldier from detection in the thermal infrared regions as well. Thermal imaging tends to be from a further distance from the subject, so it may be more important for the camouflage pattern to have larger areas of camouflage versus on a smaller pattern scale.

BRIEF SUMMARY OF THE INVENTION

A thermal camouflage garment having an outer surface area containing a first zone and a second zone. The first zone contains a first thermal camouflage fabric having a first side and a second side, where at least the first side of the first thermal camouflage fabric contains a first camouflage pattern. The first camouflage pattern contains a first printed layer, which contains at least a first, second, and third color paste. At least one of the first, second and third color pastes contain at least a first pigment, a first metallic particle, and a first binder. In at least 90% of the wavelengths between 400-700 nm, the first color paste has a reflectance at least about 6 percentage points greater than the second color paste and the third color paste has a reflectance at least about 6 percentage points less than the second color paste. In a second embodiment, in at least 90% of the wavelengths between 400-700 nm at least two pastes of the first camouflage pattern have a difference in reflectance percentage points of at least 10 points.

The second zone contains a second thermal camouflage fabric having a first side and a second side, where at least the first side of the second thermal camouflage fabric contains a second camouflage pattern. The second camouflage pattern contains a second printed layer which contains at least a fourth, fifth, and sixth color paste. At least one of the fourth, fifth, and sixth color pastes contain at least a second pigment, a second metallic particle, and a second binder. In at least 90% of the wavelengths between 400-700 nm, the fourth color paste has a reflectance at least about 6 percentage points greater than the fifth color paste and the sixth color paste has a reflectance at least about 6 percentage points less than the fifth color paste. In a second embodiment, in at least 90% of the wavelengths between 400-700 nm at least two pastes of the second camouflage pattern have a difference in reflectance percentage points of at least 10 points.

A first color delta is defined as the absolute value of the difference between the reflectance percentage of the first color paste of the first printed layer and the fourth color paste of the second color paste. The second color delta is defined as the absolute value of the difference between the reflectance percentage of the second color paste of the first printed layer and the fifth color paste of the second color paste. The third color delta is defined as the absolute value of the difference between the reflectance of the third color paste of the first printed layer and the sixth color paste of the second color paste. In at least 90% of the wavelengths between 400-700 nm the first, second, and third color deltas are less than about 10 percentage points, and wherein at 1 μm and 2 μm and the average over 3-5 μm, average over 8-12 μm at least one of the first, second, and third color deltas are greater than about 15 percentage points.

The first zone makes up at least about 10% of the outer surface area of the thermal camouflage garment and the second zone makes up at least about 10% of the outer surface area of the thermal camouflage garment.

DETAILED DESCRIPTION

Camouflage patterns are designed to blend with the background so that whatever is behind the camouflage is obscured from view. Prior to the 1980's, the main concerns were in the visible and near infrared portions of the spectrum. With the advent of detection technology in the short wave infrared (SWIR), mid wave infrared (MWIR), and long wave infrared (LWIR), there has become a need to extend the camouflage protection into these wavelengths.

In the visible region, the color of the camouflage must somewhat match the surroundings. It has been shown that using multiple colors in a pattern provides improved blending with the background if the background is not a single color. The pattern chosen must provide break up similar in scale to the background.

In the near infrared region, the portions of the pattern must reflect similar to the background as the detection device is using reflected light to form an image. Typical reflectance values range from about 10% for dark colors to about 70% for light colors. The same is true in the SWIR region. In the MWIR and LWIR the detection devices form an image of thermal energy being emitted.

In this thermal portion of the spectrum, the portions of the pattern must emit thermal energy similar to the background. Because thermal imaging is typically imaged from a location further from the pattern, it is preferable in some applications to have larger areas having differing reflectivity measurements. Instead of having individual colors in the pattern having differing reflectivities (with the spots being on the order of square millimeters), it is more important to have larger areas of contrast for example between pant legs or between the arm and chest of a shirt. The emitted energy can be a combination of reflected and transmitted energy. Typical emissivity values for the thermal portion of the spectrum range from 0.9 for the dark portions of the pattern to 0.3 for the light areas of the pattern. For simplicity, the reflectivity is basically one minus the emissivity, so the range of reflectance values in the thermal ranges from about 10% for dark areas to 70% for light areas. The printed camouflage fabric can be tailored to produce an array of visual colors which also have the desired reflectance across the remainder of the spectrum: NIR/SWIR/MWIR/LWIR.

Figure 1:
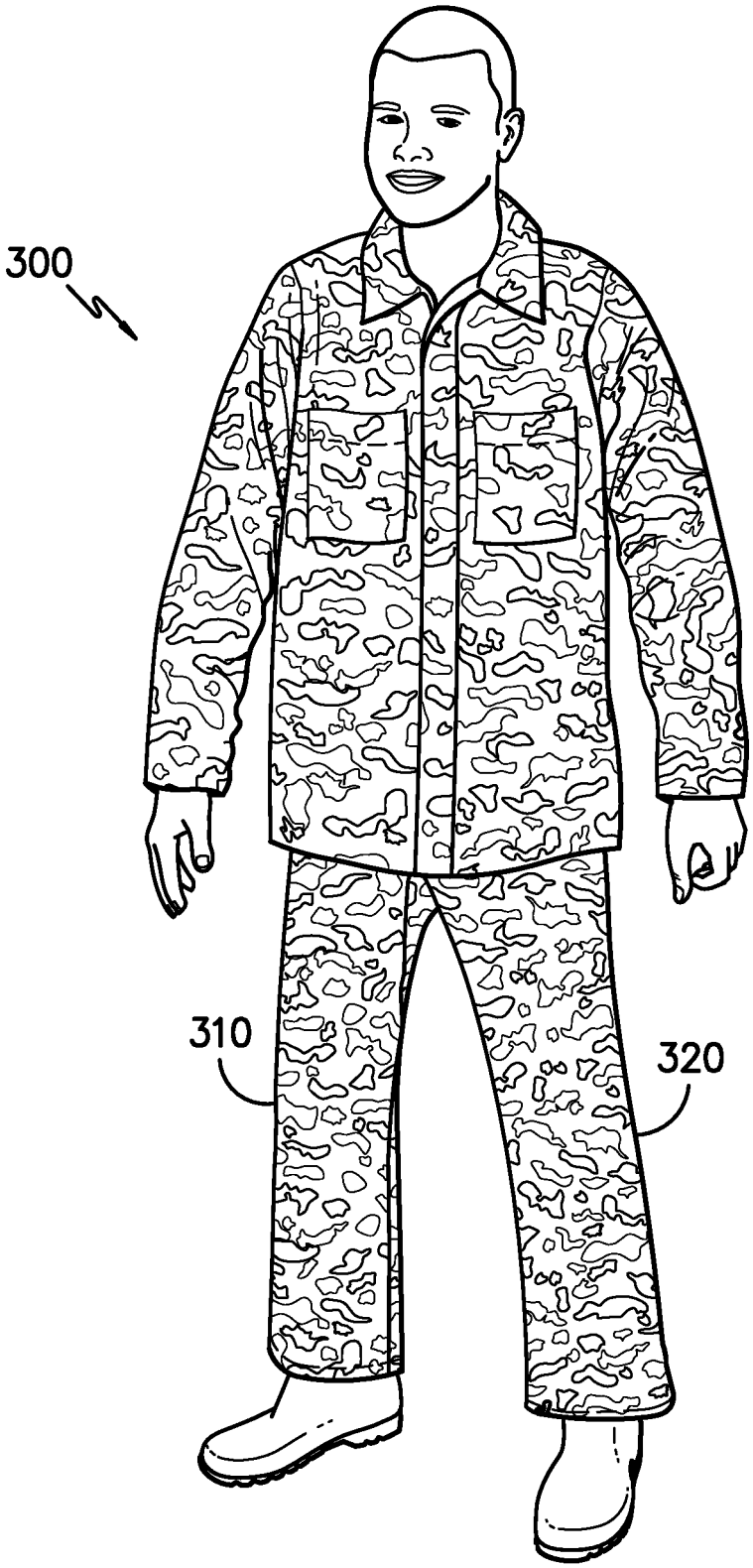
FIG. 1 illustrates a cross-sectional view of one embodiment of the thermal camouflage garment being a military uniform.

Referring now to FIG. 1, there is shown one embodiment of the thermal camouflage garment 300. The garment has an outer surface, sometimes referred to as the A surface. This outer surface is what is visible when wearing the garment. The garment 300 may be any suitable garment that requires thermal camouflage. It is particularly useful in military uniforms and that is what is shown in FIG. 1. The garment is broken into zones, these are large chunks of the area of the garment, for example (but not limited to) a pant leg, arm, chest, back, shoe, and hat/helmet. Two zones, first zone 310 and second zone 320, are shown in FIG. 1 which are a right and a left pant leg. Each of the zones within the garment 300 have set reflectivity measurements throughout the visual through thermal ranges. The first zone comprises at least about 10% of the outer surface area of the thermal camouflage garment and the second zone comprises at least about 10% of the outer surface area of the thermal camouflage garment. More preferably, each zone within the garment comprises at least 10% of the outer surface area of the garment.

The first zone 310 contains a first thermal camouflage fabric having a first side and a second side. The first side of the first thermal camouflage fabric comprises a first camouflage pattern and forms a portion of the outer surface of the garment. This first camouflage pattern comprises a first printed layer which contains at least a first, second, and third color paste. At least one of the first, second and third color pastes comprise at least a first pigment, a first metallic particle, and a first binder. In at least 90% of the wavelengths between 400-700 nm, the first color paste has a reflectance at least about 6 percentage points greater than the second color paste and the third color paste has a reflectance at least about 6 percentage points less than the second color paste.

This difference in reflectivity in the visible region gives the garment the camouflage look to the eye in the first zone 310. The first zone may also contain additional color pastes for additional colors for the camouflage fabric. In another embodiment, at least 90% of the wavelengths between 400-700 nm at least two pastes within the same printed layer have a difference in reflectance percentage points of at least 10 points, more preferably at least about 15 percentage points, more preferably at least about 20 percentage points.

The second zone 310 contains a second thermal camouflage fabric having a first side and a second side. The first side of the second thermal camouflage fabric comprises a second camouflage pattern and forms a portion of the outer surface of the garment. This second camouflage pattern comprises a first printed layer which contains at least a fourth, fifth, and sixth color paste. At least one of the fourth, fifth, and sixth color pastes comprise at least a second pigment, a second metallic particle, and a second binder. In at least 90% of the wavelengths between 400-700 nm, the fourth color paste has a reflectance at least about 6 percentage points greater than the fifth color paste and the sixth color paste has a reflectance at least about 6 percentage points less than the fifth color paste. This difference in reflectivity in the visible region gives the garment the camouflage look to the eye in the second zone 320. The second zone may also contain additional color pastes for additional colors for the camouflage fabric. In another embodiment, at least 90% of the wavelengths between 400-700 nm at least two pastes within the same printed layer have a difference in reflectance percentage points of at least 10 points, more preferably at least about 15 percentage points, more preferably at least about 20 percentage points.

One of the important aspects of this garment is the color delta, the color difference between the two zones. The first color delta is defined as the absolute value of the difference between the reflectance percentage of the first color paste of the first printed layer and the fourth color paste of the second color paste. Percentage points means percentage points on the y axis of a wavelength versus percentage reflectance chart. 50% and 60% are 10 percentage points away from each other. The second color delta is defined as the absolute value of the difference between the reflectance percentage of the second color paste of the first printed layer and the fifth color paste of the second color paste. The third color delta is defined as the absolute value of the difference between the reflectance of the third color paste of the first printed layer and the sixth color paste of the second color paste. For example, at a specified wavelength (or average or a specified range of wavelengths), the first color paste might have a reflectance of 30% and the fourth color paste might have a reflectance of 50%. The first color delta would be the absolute difference between these two reflectance percentages which would be 20%.

In one embodiment, in at least 90% of the wavelengths between 400-700 nm at least one of the first, second, and third color deltas are less than about 10 percentage points. More preferably, in at least 90% of the wavelengths between 400-700 nm at least one of the first, second, and third color deltas are less than about 5 percentage points. It is also preferred at 1 μm and 2 μm and the average over 3-5 μm, average over 8-12 μm the first, at least one of the first, second, and third color deltas are greater than about 15 percentage points. More preferably, at 1 μm and 2 μm and the average over 3-5 μm, average over 8-12 μm, at least one of the first, second, and third color deltas are greater than about 20 percentage points.

It is preferred that in at least 90% of the wavelengths between 400-700 nm each of the first, second, and third color deltas are less than about 10 percentage points. More preferably, in at least 90% of the wavelengths between 400-700 nm each of the first, second, and third color deltas are less than about 5 percentage points. It is also preferred at 1 μm and 2 μm and the average over 3-5 μm, average over 8-12 μm the first, each of the first, second, and third color deltas are greater than about 15 percentage points. More preferably, at 1 μm and 2 μm and the average over 3-5 μm, average over 8-12 μm each of the first, second, and third color deltas are greater than about 20 percentage points.

For example, the first and fourth color pastes might both look like a cream color to the eye (visual range), having a first color delta in at least 90% of the wavelengths between 400-700 nm of less than 10 percentage points. Outside of the visual range, at 1 μm and 2 μm and the average over 3-5 μm, average over 8-12 μm, the first color delta (between the first color paste and the fourth color paste) is greater than 15 percentage points. This ensures that while the two cream colors (first and fourth color pastes) look almost the same to the eye, they have a difference in reflectivity in the NIR, SWIR, and thermal ranges so the colors would look very different by instruments reading the in NIR, SWIR, and thermal ranges thus providing camouflage in those ranges.

In one embodiment, at least one of the zones have a difference in reflectivity through at least 90% of the wavelengths between 400-700 nm at least 90% of the wavelengths between 1 μm and 2 μm, the average over 3-5 μm, and the average over 8-12 μm in the color pastes within that zone. In this embodiment for the first zone, the first color paste has a reflectance at least about 6 percentage points greater than the second color paste and the third color paste has a reflectance at least about 6 percentage points less than the second color paste. In this embodiment for the second zone, the fourth color paste has a reflectance at least about 6 percentage points greater than the fifth color paste and the sixth color paste has a reflectance at least about 6 percentage points less than the fifth color paste. In this embodiment, the throughout the ranges stated, there is separation between the color pastes within each fabric zone. This may be preferred for additional camouflage.

In one embodiment, the garment further contains a third zone (and could also contain fourth, fifth, sixth, etc zones). The third zone contains a third thermal camouflage fabric having a first side and a second side, where at least the first side of the third thermal camouflage fabric comprises a third camouflage pattern. The third camouflage pattern comprises a third printed layer, where the third printed layer comprises at least a seventh, eighth, and ninth color paste. At least one of the seventh, eighth, and ninth color pastes comprise at least a third pigment, a third metallic particle, and a third binder. At least 90% of the wavelengths between 400-700 nm, at least 90% of the wavelengths, the seventh color paste has a reflectance at least about 6 percentage points greater than the eighth color paste and the nineth color paste has a reflectance at least about 6 percentage points less than the eighth color paste. Preferably, the third zone has the same color deltas as was disclosed between the first and second (so the seventh color paste would be compared to the first or fourth, the eight color paste would be compared to the second or fifth and the nineth color paste would be compared to the third or sixth). The third zone may also contain additional color pastes for additional colors for the camouflage fabric. In another embodiment, at least 90% of the wavelengths between 400-700 nm at least two pastes in the third zone have a difference in reflectance percentage points of at least 10 points, more preferably at least about 15 percentage points, more preferably at least about 20 percentage points.

The metallic particles in each zone (first metallic particles, second metallic particles, third metallic particles, etc) can be any suitable metallic material (or mixtures of metallic material). The metallic material may be, but is not limited to, aluminum, gold, silver, copper, zinc, cobalt, nickel, platinum, palladium, tin, titanium or the like, or any alloys or combinations of these metals. In one preferred embodiment, the metallic particles contain aluminum particles. Aluminum is preferred because it is readily available, relatively inexpensive, highly reflective, and light in shade. Preferably, the metallic particles have a number average particle size of between about 5 and 30 micrometers.

In one embodiment, the metallic particles used in at least one of the color pastes are aluminum particles that are non-leafing particles. Non-leafing metallic particles become fully wetted out and distribute themselves homogeneously in the paint film. As non-leafing metallic particles are distributed homogenously throughout a binder system, these are better protected from abrasion and corrosive influences. The non-leafing metallic particles preferably have a irregular, non-circular shape that is sometimes described as corn flake like. This is in comparison to the round or circular shaped, leafing metallic particles that are sometimes described as coin shaped.

In one embodiment, the total amount of metallic particles in the camouflage fabric is between 0.1 and 20% of the total weight of the camouflage fabric (both the fabric and printed layer). More preferably, the total amount of metallic particles in the camouflage fabric is between 1 and 15% of the total weight of the camouflage fabric, more preferably between about 3 and 12% of the total weight.

In one embodiment, the metallic particles in the pastes used within a zone are all the same metallic particles. In another embodiment, the metallic particles in the pastes used within a zone are different metallic particles. These different metallic particles may be the same material (such as silver) but having different shaped particles or sizes of particles or may be different materials. For example, in the first zone, the first paste may contain aluminum particles, the second paste may contain silver particles, and the third color paste may contain no metallic particles.

In another embodiment, the metallic particles in the pastes used in all of the zones are all the same metallic particle, meaning that the metallic particles used in the entire garment are the same metallic particle. In another embodiment, the metallic particles in the pastes used between zones are different metallic particles. These different metallic particles may be the same material (such as silver) but having different shaped particles or sizes of particles or may be different materials. For example, the first paste (in the first zone) may contain aluminum particles, the third paste (in the second zone) may contain silver particles.

In one embodiment, at least two of the color pastes in the first zone comprise metallic particles, preferably the same metallic particles. In one embodiment where the first color paste is light in color (in the visible region) than the third color paste, the first color paste comprises at least about twice the amount by weight of metallic particles than the third color paste, more preferably at least about 2.5 times. Also preferred is that the first color paste comprises less pigment by weight than the third color paste. In one embodiment where the fourth color paste is light in color (in the visible region) than the sixth color paste, the fourth color paste comprises at least about two times the amount by weight of metallic particles than the sixth color paste, more preferably at least about 2.5 times. Also preferred is that the fourth color paste comprises less pigment by weight than the sixth color paste.

The binder used in each of the color pastes may be any suitable binder (or mixture of binders). The binder used may be different in each color paste or may be the same in all of the color pastes within the garment. Typical binders include acrylic, acrylate, urethane, and styrene based binders. The binders have to be selected so that they are compatible with screen printing systems—they cannot set up too fast or the screens may become clogged. Some binders are self-crosslinking, some need a cross linker. A crosslinking agent is typically included to insure complete cross linking or film forming of the polymer. Typical binder loading is in the 10%-25% range based on active solids. Enough binder must be used to lock down the pigments and metal particles. The acrylics and blends comprising acrylics are preferred as they are most compatible with the screen printing operation. In another embodiment the binder is polyurethane.

Preferably, each of the first, second, and third color pastes comprise at least one pigment. Each of the first, second, and third color pastes may contain one pigment or multiple pigments depending on the color and reflectance desired. Pigments are selected to coordinate with the materials forming the color pastes. The pigments may be any suitable pigment and mixtures thereof. The pigment(s) may be inorganic or organic. In one embodiment, the pigments comprise an organic pigment. Organic pigments may be preferred for some applications due to their typically lower cost than inorganic pigments. Many of the inorganics are relatively expensive and are mainly used in applications exposed to high levels of UV light. Most colors are made with combinations of yellow, red, green, and blue pigments. Additionally, any or all of the color pastes within the garment may contain one or more dyes.

In another embodiment, at least a portion of the color pastes contain inorganic pigments such as titanium dioxide, aluminum, magnesium hydroxide, zinc sulfide, and zinc oxide. Inorganic color pigments such as iron oxides could likely be used and produce similar results to the embodiment using organic pigments. Titanium dioxide is preferred for some applications such as light shaded areas in the pattern as it produces a white color and is relatively inexpensive. The color pastes may contain any additional additives such as thickeners, dispersants, or pH adjusters or other suitable additives.

In one embodiment, the fabric 100 contains an additional metallized layer which does not significantly decrease the breathability and porosity of the camouflage fabric 100 and is preferably located between the textile and the pattern 200. The amount of porosity varies greatly for the desired end use. For example, a typical garment would likely have air permeability in the range of 15-100 $ft^3/ft^2/min$. A poncho fabric or tarp would likely have air permeability near zero. A knit used for a balaclava might have air permeability in the range of 100-400 $ft^3/ft^2/min$. In one embodiment, the garment preferably has an air permeability of at least about 10 cft/min, more preferably between about 25 and 75 cft/min.

The optional metalized layer could be applied to the camouflage fabric 100 in any suitable manner, including but not limited to, physical vapor deposition by, for example, sputter coating, vacuum vaporization, chemical vapor deposition, electroless plating, electrostatic coating preferably before applying the camouflage pattern to the textile. The first metalized layer can also be applied using dip coating, curtain coating, knife coating, gravure coating, printing, or by other known coating techniques. The emissivity of the metal coating can range from 0.04 to 1, depending on the desired thermal performance. The emissivity/reflectivity in the thermal portion of the spectrum is measured with the Surface Optics SOC 410 Hand Held DHR Reflectometer. In the case where a uniform metal is applied to the fabric first, a high reflectance is most desirable as it can be tuned down with the color layers. In the case where the metal is mixed in the print paste, the reflectivity is tuned by color to the appropriate reflectivity. The metal used in the optional metallized layer can be any suitable metal that produces the desired reflective effect, such as aluminum, gold, silver, copper, zinc, cobalt, nickel, platinum, palladium, tin, titanium or the like, or any alloys or combinations of these metals.

In one embodiment, at least one of the color pastes in at least one of the zones comprises carbon black. Carbon black may be used if the reflectance of a particular color needs to be reduced. It has been found that carbon black is readily miscible with water and easily goes in the color paste. Carbon black is adjustable from color to color in varying amounts, depending on the requirements of the desired reflectance curves. The carbon black can be used as a shading component in place of a blue dyestuff in the case of lighter colors where the two may compete for the overall color match. In one embodiment, the amount of carbon black in each color that contains carbon black is between about 0.5 and 100 grams per kilogram of the color. In one embodiment, at least one of the color pastes within each zone comprise carbon black. In another embodiment, each color paste in all of the zones of the garment comprise carbon black.

Figure 2:
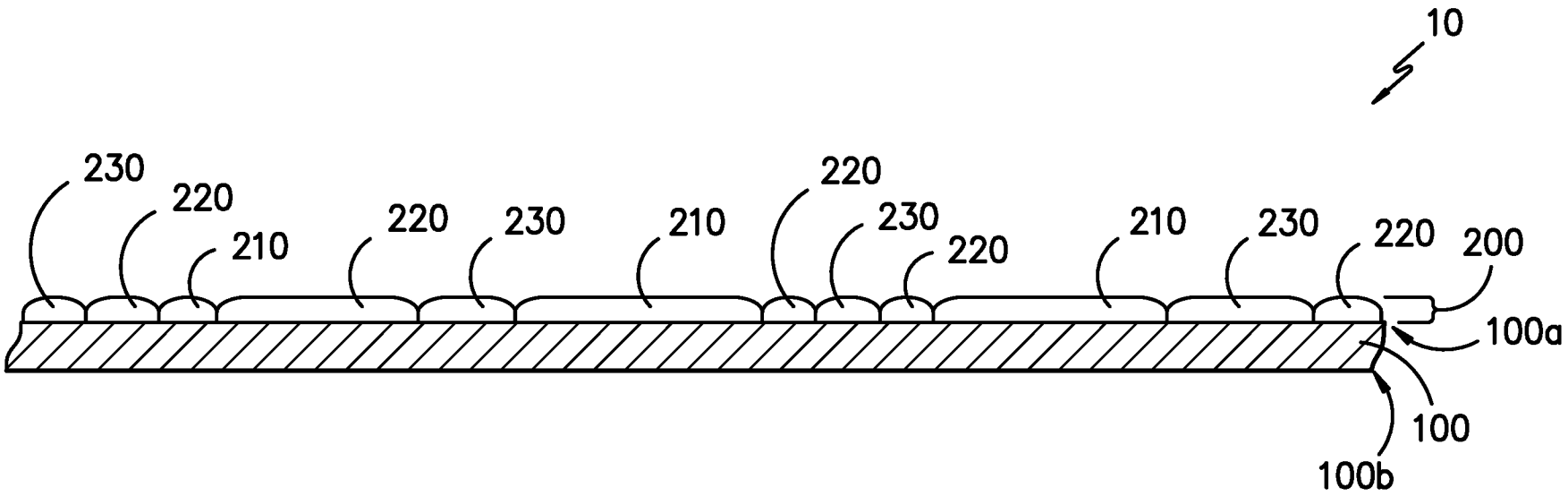
FIG. 2 illustrates a cross-sectional view of one embodiment of the thermal camouflage fabric.

Referring now to FIG. 2, the camouflage fabric 100 has a first side 100*a* and a second side 100*b*. The textile may be any suitable textile including a woven, non-woven, or knit textile. The first side 100*a* forms the outer surface of the garment 300.

In one embodiment, the camouflage fabric 100 is a woven textile. The weave may be, for example, plain, satin, twill, basket-weave, poplin, jacquard, or crepe weave textiles. Preferably, the textile materials are provided in a woven construction, such as a plain weave, basket weave, twill weave, satin weave, or sateen weave. Suitable plain weaves include, but are not limited to, ripstop weaves produced by incorporating, at regular intervals, extra yarns or reinforcement yarns in the warp, fill, or both the warp and fill of the textile material during formation. Suitable twill weaves include both warp-faced and fill-faced twill weaves, such as 2/1, 3/1, 3/2, 4/1, 1/2, 1/3, or 1/4 twill weaves. In certain embodiments of the invention, such as when the textile material is formed from two or more pluralities or different types of yarns, the yarns are disposed in a patternwise arrangement in which one of the yarns is predominantly disposed on one surface of the textile material. In other words, one surface of the textile material is predominantly formed by one yarn type. Suitable patternwise arrangements or constructions that provide such a textile material include, but are not limited to, satin weaves, sateen weaves, and twill weaves in which, on a single surface of the fabric, the fill yarn floats and the warp yarn floats are of different lengths.

In another embodiment, the camouflage fabric 100 is a knit textile, for example a circular knit, reverse plaited circular knit, double knit, single jersey knit, two-end fleece knit, three-end fleece knit, terry knit or double loop knit, weft inserted warp knit, warp knit, and warp knit with or without a micro-denier face.

In another embodiment, the camouflage fabric 100 is a multi-axial, such as a tri-axial textile (knit, woven, or non-woven). In another embodiment, the camouflage fabric 100 is a bias textile. In another embodiment, the textile is a unidirectional textile and may have overlapping yarns or may have gaps between the yarns.

In another embodiment, the camouflage fabric 100 is a non-woven textile. The term "non-woven" refers to structures incorporating a mass of yarns or fibers that are entangled and/or heat fused so as to provide a coordinated structure with a degree of internal coherency. Non-woven textiles may be formed from many processes such as for example, meltspun processes, hydroentangeling processes, mechanically entangled processes, stitch-bonding processes and the like.

The camouflage fabric 100 contains any suitable yarns. "Yarn", in this application, as used herein includes a monofilament elongated body, a multifilament elongated body, ribbon, strip, yarn, tape, fiber and the like. The camouflage fabric 100 may contain one type of yarn or a plurality of any one or combination of the above. The yarns may be of any suitable form such as spun staple yarn, monofilament, or multifilament, single component, bi-component, or multi-component, and have any suitable cross-section shape such as circular, multi-lobal, square or rectangular (tape), and oval.

The camouflage fabric 100 can be formed from a single plurality or type of yarn (e.g., the fabric can be formed solely from yarns comprising a blend of cellulosic fibers and synthetic fibers, such as polyamide fibers), or the textile can be formed from several pluralities or different types of yarns (e.g., the fabric can be formed from a first plurality of yarns comprising cellulosic fibers and polyamide fibers and a second plurality of yarns comprising an inherent flame resistant fiber). In one preferred embodiment, the fibers in the textile may include filament nylon, and polyester and spun nylon, polyester, cotton, SPANDEX™ (or other elastic fibers) and/or nomex.

Preferably, the textile comprises cellulosic fibers. As utilized herein, the term "cellulosic fibers" refers to fibers composed of, or derived from, cellulose. Examples of suitable cellulosic fibers include cotton, rayon, linen, jute, hemp, cellulose acetate, and combinations, mixtures, or blends thereof. Preferably, the cellulosic fibers comprise cotton fibers.

In those embodiments in which the textile comprises cellulosic fibers, the cellulosic fibers can be present in the textile in any suitable amount. For example, in certain embodiments, the cellulosic fibers can comprise about 15% or more, about 20% or more, about 25% or more, about 30% or more, or about 35% or more, by weight, of the fibers present in the textile. While the inclusion of cellulosic fibers can improve the comfort of the textile (e.g., improve the hand and moisture absorbing characteristics), the exclusive use of cellulosic fibers may affect the durability of the textile. Accordingly, it may be desirable to use other fibers (e.g., synthetic fibers) in combination with the cellulosic fibers in order to achieve a desired level of durability. Thus, in such embodiments, the cellulosic fibers can comprise about 95% or less or about 90% or less, by weight, of the fibers present in the textile. More specifically, in certain embodiments, the cellulosic fibers can comprise about 15% to about 95%, about 20% to about 95%, about 25% to about 95%, about 30% to about 95%, or about 30% to about 90%, by weight, of the fibers present in the textile material.

In certain embodiments of the invention, one or more of the yarns in the textile can comprise thermoplastic synthetic fibers. For example, the yarn can comprise a blend of cellulosic fibers and thermoplastic synthetic fibers. These thermoplastic synthetic fibers typically are included in the textile in order to increase its durability. This increased durability of the yarn, in turn, leads to an increased durability for the textile. Suitable thermoplastic synthetic fibers include, but are not necessarily limited to, polyester fibers (e.g., poly(ethylene terephthalate) fibers, poly(propylene terephthalate) fibers, poly(trimethylene terephthalate) fibers), poly(butylene terephthalate) fibers, and blends thereof), polyamide fibers (e.g., nylon 6 fibers, nylon 6,6 fibers, nylon 4,6 fibers, and nylon 12 fibers), polyvinyl alcohol fibers, an elastic polyester-polyurethane copolymer (SPANDEX®), flame-resistant meta-aramid (NOMEX®) and combinations, mixtures, or blends thereof. In one preferred embodiment, the textile comprises cotton and nylon yarns. In another embodiment, the textile comprises nylon and spandex yarns.

In those embodiments in which the textile comprises thermoplastic synthetic fibers, the thermoplastic synthetic fibers can be present in one of the pluralities or types of yarn used in making the textile in any suitable amount. In certain preferred embodiments, the thermoplastic synthetic fibers comprise about 65% or less, about 60% or less, or about 50% or less, by weight, of the fibers present in one of the pluralities or types of yarn used in making the textile material. In certain preferred embodiments, the thermoplastic synthetic fibers comprise about 5% or more or about 10% or more, by weight, of the fibers present in one of the pluralities or types of yarn used in making the textile material. Thus, in certain preferred embodiments, the thermoplastic synthetic fibers comprise about 0% to about 65% (e.g., about 5% to about 65%), about 5% to about 60%, or about 10% to about 50%, by weight, of the fibers present in one of the pluralities or types of yarn used in making the textile material.

In one preferred embodiment, the textile comprises a plurality of yarns comprising a blend of cellulosic fibers and synthetic fibers (e.g., synthetic staple fibers). In this embodiment, the synthetic fibers can be any of those described above, with polyamide fibers (e.g., polyamide staple fibers) being particularly preferred. In such an embodiment, the cellulosic fibers comprise about 30% to about 90% (e.g., about 40% to about 90%, about 50% to about 90%, about 70% to about 90%, or about 75% to about 90%), by weight, of the fibers present in the yarn, and the polyamide fibers comprise about 10% to about 50% (e.g., about 10% to about 40%, about 10% to about 35%, about 10% to about 30%, or about 10% to about 25%), by weight, of the fibers present in the yarn. In one preferred embodiment, the textile contains a blend of nylon and cotton (such as 80/20, 52/48), sometimes referred to as NyCo fabric.

Certain embodiments of the textile of the invention contain yarns comprising inherent flame resistant fibers. As utilized herein, the term "inherent flame resistant fibers" refers to synthetic fibers which, due to the chemical composition of the material from which they are made, exhibit flame resistance without the need for an additional flame retardant treatment. In such embodiments, the inherent flame resistant fibers can be any suitable inherent flame resistant fibers, such as polyoxadiazole fibers, polysulfonamide fibers, poly(benzimidazole) fibers, poly(phenylenesulfide) fibers, meta-aramid fibers, para-aramid fibers, polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, polyamide-imide fibers and combinations, mixtures, or blends thereof. In certain embodiments, the inherent flame resistant fibers are preferably selected from the group consisting of polyoxadiazole fibers, polysulfonamide fibers, poly(benzimidazole) fibers, poly(phenylenesulfide) fibers, meta-aramid fibers, para-aramid fibers, and combinations, mixtures, or blends thereof.

The inherent flame resistant fibers can be present in the textile in any suitable amount. Generally, the amount of inherent flame resistant fibers included in the textile will depend upon the desired properties of the final textile. In certain embodiments, the inherent flame resistant fibers can comprise about 20% or more, about 25% or more, about 30% or more, about 35% or more, about 40% or more, or about 45% or more, by weight, of the fibers present in the textile. In certain embodiments, the inherent flame resistant fibers can comprise about 75% or less, about 70% or less, about 65% or less, about 60% or less, about 55% or less, about 50% or less, about 45% or less, or about 40% or less, by weight, of the fibers present in the textile. Thus, in certain embodiments, the inherent flame resistant fibers can comprise about 20% to about 70%, about 25% to about 75% (e.g., about 25% to about 60%, about 25% to about 50%, about 25% to about 45%, or about 25% to about 40%), about 30% to about 70%, about 35% to about 65%, about 40% to about 60%, or about 45% to about 55%, by weight, of the fibers present in the textile.

In one embodiment, the camouflage patterns (first, second, third, etc) cover at least a portion of the outer surface of the garment 300. In another embodiment, the camouflage pattern covers essentially the entire outer surface of the garment 300 (essentially all meaning at least 95% of the surface area).

In one embodiment, the camouflage patterns cover essentially the whole camouflage fabrics (first, second, etc). In another preferred embodiment, the camouflage pattern is applied to the textile in a pattern. This pattern may be regular or random, may cover between about 1 and 100% of the surface area of the textile. In another embodiment, the pattern may cover between about 2% and 98%, more preferably between about 10 and 90%. Preferably, the camouflage pattern comprises a typical military style pattern for either woodlands or desert. In the camouflage pattern, the colors may contain different areas having different compositions (such as different colors printed on different parts of a garment to form a camouflage pattern). In some cases the different compositions touch, in some cases there is space between the different compositions, and in some cases there is overlap of the different compositions. In all of these cases, the entire printed layer will be considered to be the camouflage pattern 200. In one embodiment, at least a portion of the first, second, and third color pastes are in discrete locations in the first printed layer and wherein at least a portion of the fourth, fifth, and sixth color pastes are in discrete locations in the second printed layer. This is shown for example in FIG. 2 where the first color paste 210, second color paste 220, and third color paste 230 are in discrete locations in the first print layer 200 on the first fabric 100 and there is minimal to no overlap in color pastes.

Separation is important across the spectrum from the visual to the thermal. This is what gives the camouflage pattern the break-up that is needed to better blend with non-uniform backgrounds. Each "color" in the pattern should mimic the spectral response of something in the natural scene. For example, tan might represent sand, green might represent foliage, and brown might represent tree trunks. Most scenes have a range of reflectance, so to achieve a blending effect, the camouflage must have at least several levels of reflectance; one near the lower end, one in the middle, and one near the upper end. These naturally occurring items in the scene have characteristic reflectance curves which are separate from one another. This is what drives the need for camouflage colors to have similar separation. The idea is to make the camouflage closely mimic the background at all critical wavelengths.

Although the reflectance of an object is continuous across the spectrum, sensors operate in certain bands within the spectrum. NIR sensors work in the 700-900 nm range, SWIR sensors work in the 900-2500 nm range, MWIR sensors work in the 3500-5000 nm range, and LWIR sensors work in the 8000-14000 nm range. These sensors generally create an image by integrating the reflectance within the range and creating an image. Hyperspectral sensors are relatively new and operate in the 400-2500 nm range. They are capable of creating multiple images at very specific wavelengths within the range. As these sensors sample just a slice of the spectrum, it is important to have separation at essentially all wavelengths.

The reflectance of the colors is measured in four wavelength sections: at least 90% of the wavelengths between 400-700 nm, at least 90% of the wavelengths between 1 μm and 2 μm, the average over 3-5 μm, and the average over 8-12 μm. To measure in these sections, one would need to measure all (a reasonable number of measurements) in the 1 μm to 2 μm wavelength and at least 90% of those measurements would have to meet the desired reflectance separation numbers. The average reflectance over 3-5 μm and the average over 8-12 μm would also be measured. Measurements for reflectance are measured through the camouflage fabric (the fabric and the printed layer). Additional layers added to the camouflage fabric may alter the reflectivity and other properties (such as air permeability).

Figure 3:
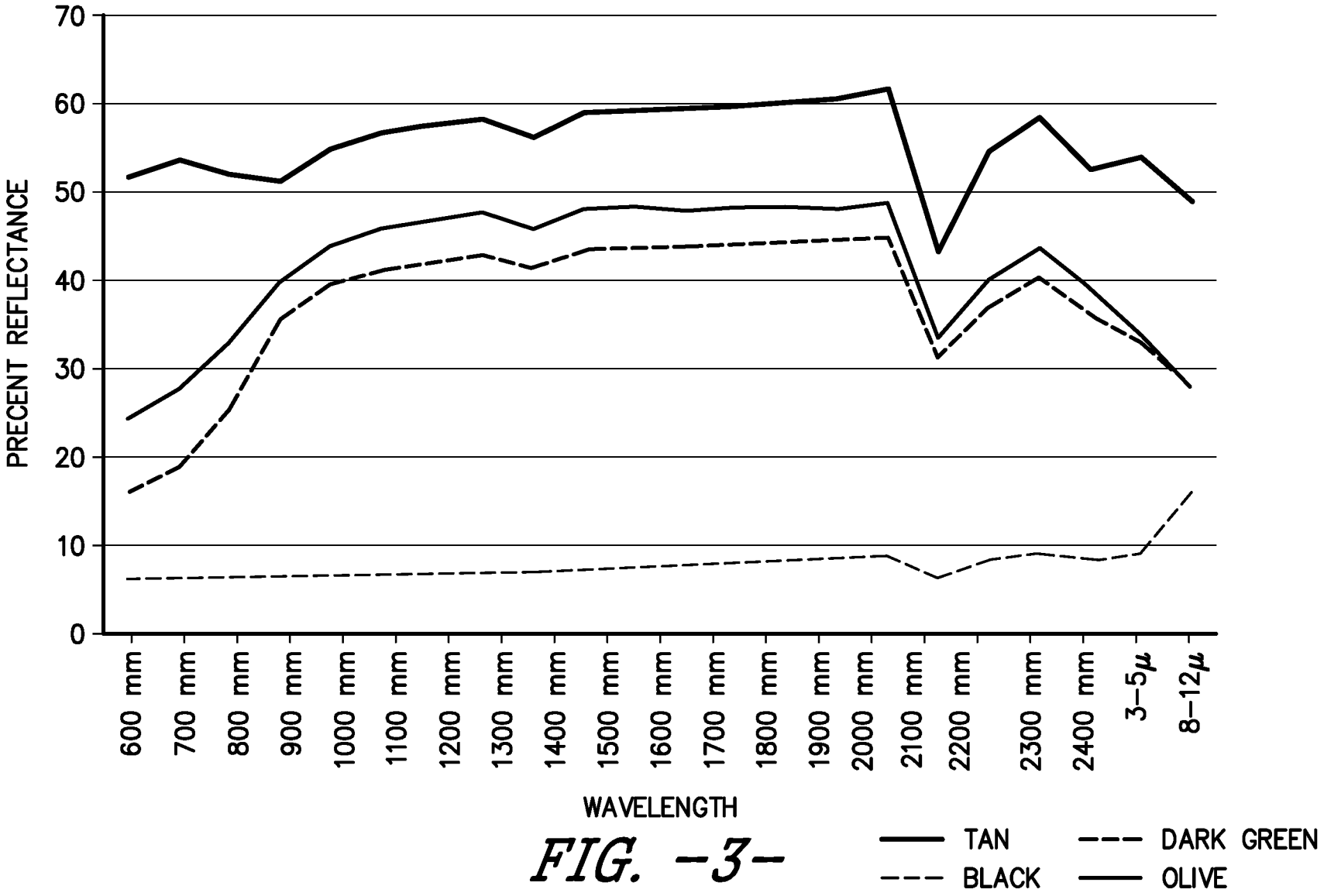
FIG. 3 is a graph showing the reflectance by wavelength of a four color camouflage pattern.

As one can see from FIG. 3 showing one embodiment of a first thermal camouflage fabric, the % reflectance versus wavelength is not typically a straight line. This fabric does meet the embodiment where the first color paste is at least 6 percentage points greater than the second color paste and the second color paste is at least 6 percentage points greater than the third color paste in at least 90% of the wavelengths between 1 μm and 2 μm, the average over 3-5 μm, and the average over 8-12 μm.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A thermal camouflage garment having an outer surface area comprising:

a first zone comprising a first thermal camouflage fabric having a first side and a second side, wherein at least the first side of the first thermal camouflage fabric comprises a first camouflage pattern, wherein the first camouflage pattern comprises a first printed layer, wherein the first printed layer comprises at least a first, second, and third color paste, wherein at least one of the first, second and third color pastes comprise at least a first pigment, a first metallic particle, and a first binder, wherein in at least 90% of the wavelengths between 400-700 nm, the first color paste has a reflectance at least about 6 percentage points greater than the second color paste and the third color paste has a reflectance at least about 6 percentage points less than the second color paste, a second zone comprising a second thermal camouflage fabric having a first side and a second side, wherein at least the first side of the second thermal camouflage fabric comprises a second camouflage pattern, wherein the second camouflage pattern comprises a second printed layer, wherein the second printed layer comprises at least a fourth, fifth, and sixth color paste, wherein at least one of the fourth, fifth, and sixth color pastes comprise at least a second pigment, a second metallic particle, and a second binder, wherein in at least 90% of the wavelengths between 400-700 nm, the fourth color paste has a reflectance at least about 6 percentage points greater than the fifth color paste and the sixth color paste has a reflectance at least about 6 percentage points less than the fifth color paste, wherein a first color delta is defined as the absolute value of the difference between the reflectance percentage of the first color paste of the first printed layer and the fourth color paste of the second printed layer, wherein the second color delta is defined as the absolute value of the difference between the reflectance percentage of the second color paste of the first printed layer and the fifth color paste of the second printed layer color paste, wherein the third color delta is defined as the absolute value of the difference between the reflectance of the third color paste of the first printed layer and the sixth color paste of the second printed layer, wherein in at least 90% of the wavelengths between 400-700 nm the first, second, and third color deltas are less than about 10 percentage points, and wherein at 1 μm and 2 μm and the average over 3-5 μm, average over 8-12 μm at least one of the first, second, and third color deltas are greater than about 15 percentage points, wherein the first zone comprises at least about 10% of the outer surface area of the thermal camouflage garment and the second zone comprises at least about 10% of the outer surface area of the thermal camouflage garment.

2. The thermal camouflage garment of claim 1, wherein in at least 90% of the wavelengths between 1 μm and 2 μm, the average over 3-5 μm, and the average over 8-12 μm, the first color paste has a reflectance at least about 6 percentage points greater than the second color paste and the third color paste has a reflectance at least about 6 percentage points less than the second color paste.

3. The thermal camouflage garment of claim 1, wherein in at least 90% of the wavelengths between 400-700 nm the first, second, and third color deltas are less than about 5 percentage points.

4. The thermal camouflage garment of claim 1, further comprising a third zone comprising a third thermal camouflage fabric having a first side and a second side, wherein at least the first side of the third thermal camouflage fabric comprises a third camouflage pattern, wherein the third camouflage pattern comprises a third printed layer, wherein the third printed layer comprises at least a seventh, eighth, and ninth color paste, wherein at least one of the seventh, eighth, and ninth color pastes comprise at least a third pigment, a third metallic particle, and a third binder, wherein in at least 90% of the wavelengths between 400-700 nm, at least 90% of the wavelengths, the seventh color paste has a reflectance at least about 6 percentage points greater than the eighth color paste and the nineth color paste has a reflectance at least about 6 percentage points less than the eighth color paste.

5. The thermal camouflage garment of claim 1, wherein at least one of the color pastes comprise carbon black.

6. The thermal camouflage garment of claim 1, wherein at least one of the color pastes of each printed layer comprise carbon black.

7. The thermal camouflage garment of claim 1, wherein each color paste comprises carbon black.

8. The thermal camouflage garment of claim 1, wherein the first color paste comprises at least about two times the amount by weight of metallic particles than the third color paste.

9. The thermal camouflage garment of claim 1, wherein the fourth color paste comprises at least about two times the amount by weight of metallic particles than the sixth color paste.

10. The thermal camouflage garment of claim 1, wherein the plurality of metallic particles has a number average particle size of between about 5 and 30 micrometers.

11. The thermal camouflage garment of claim 1, wherein at least a portion of the first, second, and third color pastes are in discrete locations in the first printed layer and wherein at least a portion of the fourth, fifth, and sixth color pastes are in discrete locations in the second printed layer.

12. The thermal camouflage garment of claim 1, wherein the thermal camouflage garment has an air permeability of between 15-100 $ft^3/ft^2/min$.

13. A thermal camouflage garment having an outer surface area comprising:

a first zone comprising a first thermal camouflage fabric having a first side and a second side, wherein at least the first side of the first thermal camouflage fabric comprises a first camouflage pattern, wherein the first camouflage pattern comprises a first printed layer, wherein the first printed layer comprises at least a first, second, and third color paste, wherein at least one of the first, second and third color pastes comprise at least a first pigment, a first metallic particle, and a first binder, wherein in at least 90% of the wavelengths between 400-700 nm at least two pastes have a difference in reflectance percentage points of at least 10 points, a second zone comprising a second thermal camouflage fabric having a first side and a second side, wherein at least the first side of the second thermal camouflage fabric comprises a second camouflage pattern, wherein the second camouflage pattern comprises a second printed layer, wherein the second printed layer comprises at least a fourth, fifth, and sixth color paste, wherein at least one of the fourth, fifth, and sixth color pastes comprise at least a second pigment, a second metallic particle, and a second binder, wherein in at least 90% of the wavelengths between 400-700 nm at least two pastes have a difference in reflectance percentage points of at least 10 points, wherein a first color delta is defined as the absolute value of the difference between the reflectance percentage of the first color paste of the first printed layer and the fourth color paste of the second printed layer, wherein the second color delta is defined as the absolute value of the difference between the reflectance percentage of the second color paste of the first printed layer and the fifth color paste of the second printed layer, wherein the third color delta is defined as the absolute value of the difference between the reflectance of the third color paste of the first printed layer and the sixth color paste of the second printed layer, wherein in at least 90% of the wavelengths between 400-700 nm the first, second, and third color deltas are less than about 10 percentage points, and wherein at 1 μm and 2 μm and the average over 3-5 μm, average over 8-12 μm at least one of the first, second, and third color deltas are greater than about 15 percentage points, wherein the first zone comprises at least about 10% of the outer surface area of the thermal camouflage garment and the second zone comprises at least about 10% of the outer surface area of the thermal camouflage garment.

14. The thermal camouflage garment of claim 13, wherein in at least 90% of the wavelengths between 400-700 nm the first, second, and third color deltas are less than about 5 percentage points.

15. The thermal camouflage garment of claim 13, wherein in at least 90% of the wavelengths between 1 μm and 2 μm, the average over 3-5 μm, and the average over 8-12 μm the first, second, and third color deltas greater than about 20 percentage points.

16. The thermal camouflage garment of claim 13, further comprising a third zone comprising a third thermal camouflage fabric having a first side and a second side, wherein at least the first side of the third thermal camouflage fabric comprises a third camouflage pattern, wherein the third camouflage pattern comprises a third printed layer, wherein the third printed layer comprises at least a seventh, eighth, and ninth color paste, wherein at least one of the seventh, eighth, and ninth color pastes comprise at least a third pigment, a third metallic particle, and a third binder, wherein in at least 90% of the wavelengths between 1 μm and 2 μm, the average over 3-5 μm, and the average over 8-12 μm, the seventh color paste has a reflectance at least about 6 percentage points greater than the eighth color paste and the nineth color paste has a reflectance at least about 6 percentage points less than the eighth color paste.

17. The thermal camouflage garment of claim 13, wherein at least one of the color pastes of each printed layer comprise carbon black.

18. The thermal camouflage garment of claim 13, wherein each color paste comprises carbon black.

19. The thermal camouflage garment of claim 13, wherein the first color paste comprises at least about two times the amount by weight of metallic particles than the third color paste.

20. The thermal camouflage garment of claim 13, wherein the thermal camouflage garment has an air permeability of between 15-100 $ft^3/ft^2/min$.

* * * * *